US005248093A

United States Patent [19]

Pleasants

[11] Patent Number: 5,248,093

[45] Date of Patent: Sep. 28, 1993

[54] ROBOTIC LAWN SPRINKLER

[76] Inventor: Frank M. Pleasants, 6574 S. Cody Way, Littleton, Colo. 80123

[21] Appl. No.: 792,285

[22] Filed: Nov. 14, 1991

[51] Int. Cl.[5] ..... B05B 3/16

[52] U.S. Cl. ..... 239/239; 239/DIG. 1

[58] Field of Search ..... 239/237, DIG. 1, 240, 239/239

[56] References Cited

U.S. PATENT DOCUMENTS

| | | | |
|---|---|---|---|
| 1,637,413 | 8/1927 | Elder | 239/DIG. 1 X |
| 2,757,956 | 8/1956 | Salminen | 239/DIG. 1 X |
| 2,962,220 | 11/1960 | Woods | 239/DIG. 1 X |
| 2,979,271 | 4/1961 | Boyden | 239/236 |
| 3,575,347 | 4/1971 | Carlson | 239/DIG. 1 X |
| 3,878,990 | 4/1975 | Geraudie | 239/DIG. 1 X |
| 3,952,954 | 4/1965 | Taylor | 239/DIG. 1 X |
| 4,474,328 | 10/1984 | Hale | 239/227 |
| 4,540,125 | 9/1985 | Gorney | 239/232 |
| 4,624,412 | 11/1986 | Hunter | 239/DIG. 1 X |
| 4,648,588 | 3/1987 | Rabitsch | 239/DIG. 1 X |

*Primary Examiner*—Andres Kashnikow
*Assistant Examiner*—Kevin Weldon
*Attorney, Agent, or Firm*—Gree I. Anderson

[57] ABSTRACT

An automatic robotic lawn sprinkler providing a water powered, articulated, actuation and control system aiming a continuous stream of water to all coordinates within a polar coordinate system comprising a manually programmable base assembly for anchoring to the ground and containing site specific range data, an azimuth rotor assembly rotatably mounted to the base in a horizontal plane, a range rotor assembly rotatably mounted in a vertical plane substantially perpendicular to the azimuth rotor, an azimuth actuation and control system, range actuation and control system, and a mechanism for variably controlling range rate and flow volume.

4 Claims, 3 Drawing Sheets

ROBOTIC LAWN SPRINKLER

FIELD OF THE INVENTION

The present invention relates to sprinklers for irrigation purposes and more particularly to robotic sprinklers programmable to accurately cover irregular shaped areas.

BACKGROUND OF THE INVENTION

In the past, water has been a plentiful and inexpensive commodity; however, it is becoming increasingly scarce and more expensive. Accordingly, past sprinklers utilized techniques to approximate uniform coverage by overlapping circles and sectors of circles, rectangular shapes and more recently irregular shapes; however, the previous art until the present invention, has failed to address the shortcomings of the underlying approach in dispersing the water. Whether they are impact, rotary or oscillating sprinklers, all known sprinklers attempt to produce a more or less uniform linear cord of spray and to advance this linear cord in a straight or circular path generally perpendicular to this cord. Furthermore, to generate these uniform cords of spray, water streams are impinged upon objects or forced through small openings to generate small droplets and mist uniformly distributed along the length of the cord.

This method creates a wide range of droplets sizes ranging from large drops to a fine mist with the larger drops traveling the greatest distance and the smaller drops decelerating quickly and falling short as a result of their respective aerodynamics. Even recent sprinklers which claim to cover irregular shapes still use a uniform cord of water adjusted in length by changing the elevation angle (range) or lowering a shield in front of the stream thereby breaking the entire stream into mist. The mist is generally lost by drifting in winds and evaporating.

Furthermore, with these small droplets, it is necessary to thoroughly saturate the organic lawn material until water can agglomerate into large droplets which make their way down to the soil. All the while, the organic matter is maintained in a saturated condition over essentially the total area which further increases evaporation. Ultimately, most water left in surface vegetation is lost to evaporation instead of being taken in by the roots. Losses are further increased because particles of small aerodynamic diameters drift and are difficult to accurately direct to the lawn.

The second aspect of efficiency which the present invention resolves is precise pointing. It is this precision which is most obvious to the user and consequently represents his main advantage. Perhaps the most undesirable characteristic of a watering system is for water to strike a building, walk, street or other unwanted area. For irregular shaped lawns, to avoid striking unwanted areas the water source must be located at many locations. For buried systems this means many separate heads and consequently more cost. For portable systems, this means moving the sprinkler many times and consequently more wasted user time and more inconvenience.

As an example of control difficulties, a commercial embodiment of U.S. Pat. No. 4,637,549 utilizes the lowered screen to prevent excessive range by disintegrating large droplets. In addition to the increased evaporation as previously described, the stream is diverted into a 30 or 40 degree wide wedge which by the manufacturer's own admission makes tight control impossible. Other patents cite controlled coverage as their advantage; however, it is the failure of these devices to address the fundamental deficiencies of the control method which defeats these attempts.

U.S. Pat. No. 2,757,956 which departs considerably from the other references falls far short of the performance of the present invention. While Salminen teaches improved efficiency by providing rectangular patterns to prevent the required overlapping of circles, he specifies a device which is inherently inefficient. To obtain zero range, his device discharges water vertically upwards. This produces maximum evaporation, dispersion and potential for aiming error. Only a slight breeze or aiming error will cause the trajectory to vary greatly from the desired target. He addresses only the inefficiency of overlapping circular areas but fails to observe the need to follow irregular boundaries while eliminating multiple sprinklers and providing precise aiming. The complex needs of the field of this invention are not obvious and until the present invention have evaded a solution.

It is precision in range and precision in azimuth which the present invention provides to overcome these problems. Precision is provided in azimuth by the radial, non-rotary, action of the present invention. By indexing azimuth in narrow bands of approximately 3 to 6 degrees, and using a "power nozzle" with a comparable angle of dispersion, the present invention produces sharp cuts in azimuth. And due to the discrete stationary azimuth positions, the device can go from minimum range to maximum range and, vice versa within one azimuth increment. By the use of variable range angle and/or variable water pressure, the present invention provides a maximum to minimum radius (or "turn down ratio") of 5:1 or greater. In actuality, by varying the water pressure to a bubble tight shut off in several embodiments of the invention, the device can completely eliminate water coverage to any desired azimuth positions.

A valve linked to the range setting within the present invention decreases pressure at close in ranges. This has the combined effect of eliminating the damaging water blasting of close-in vegetation, decreasing the total water applied to the proportionally smaller close in areas, and decreasing the range simultaneously. This produces tight radial control and uniform watering.

A further embodiment of the present invention is provided by the addition of a second site specific data base. This data base contains information regulating the minimum desired range. The combination of the maximum range and this minimum range at site specific azimuth angles and a tight shut-off valve provides a discontinuous, point watering, system. This point watering system waters discrete trees, shrubs gardens and architectural landscapes. While existing drip watering and root watering systems provide this precision, they do it at extensive cost and extreme inflexibility to change the pattern of water distribution.

This apparatus and control system lends itself equally to above ground or buried, "pop-up" sprinkler systems. Within the latter version, the base is designed to be buried and a piston device is interstitially configured between the base and the azimuth rotor.

The embodiments of the present invention thereby provide a water powered, articulated, actuation and control system which aims a precision, power jet, consolidated water stream to all coordinates within a polar coordinate system.

DETAILED DESCRIPTION OF THE INVENTION

Figure 1:
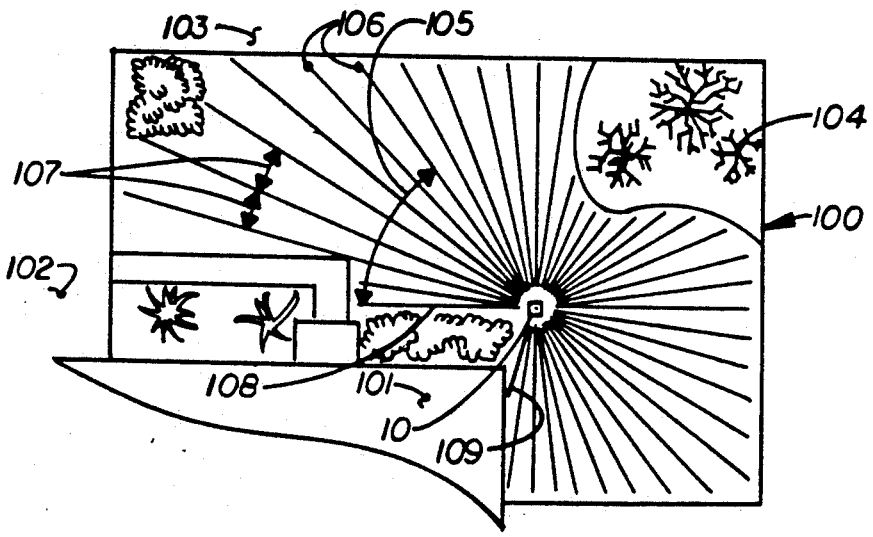
FIG. 1 is a schematic top plan view of the present invention and its operative relationship to an irregular area and a building structure.

In FIG. 1 there is illustrated a robotic sprinkler apparatus 10 for watering irregular shaped lawns 100 shown bordered on the sides by residence 101, drive way 102, street 103, and area of low water consuming plants 104. The structure, actuation means and controls combine to define a polar coordinate system with the apparatus 10 forming the pole, the nozzle direction defining the azimuthal coordinate 105 and the variable trajectory of the water defining the range coordinate 106.

The preferred embodiment establishes uniform water coverage by indexing uniformly in azimuth by the indexing angle 107 and directing the trajectory of a stream of water emitting from the nozzle to advance uniformly from one radial extreme to the other at that azimuth. Zero range is at apparatus 10 and the azimuth specific maximum range 106 is defined by the intersection of the radial path of the water and the irregular boundary of the watered area. Thus, lawn 100 is uniformly covered by wedges of water, azimuth indexing angle 107 wide by azimuth specific maximum range 106 long.

It is appreciated that for uniform water coverage, the dispersion angle of the nozzle must correspond to the azimuth indexing angle 107 of the apparatus. And further, to maintain uniform water coverage, watering time and/or watering flow rate must increase proportionally as range increases. The present invention is shown later to do this.

The maximum range of radial path 108 varies as a function of azimuth orientation and the preset, site specific data stored within apparatus 10 for the respective azimuth direction, as will be later shown. Azimuth extremes 109, 110, 111 and 112 likewise are site specific and defined by various control means as will be later shown. In that there is no preset zero azimuth stored within the device, this setting is site specific and to be set by the user or the unit is left to index in the same direction through 360 degrees and repeat continuously.

An alternate embodiment which is not shown in the present patent is the rearrangement of elements to establish uniform water coverage by uniformly indexing range while advancing azimuth to form uniform arcs with site specific extremes. This embodiment can produce equally desirable operation but is not preferred due to increased data storage.

Figure 2:
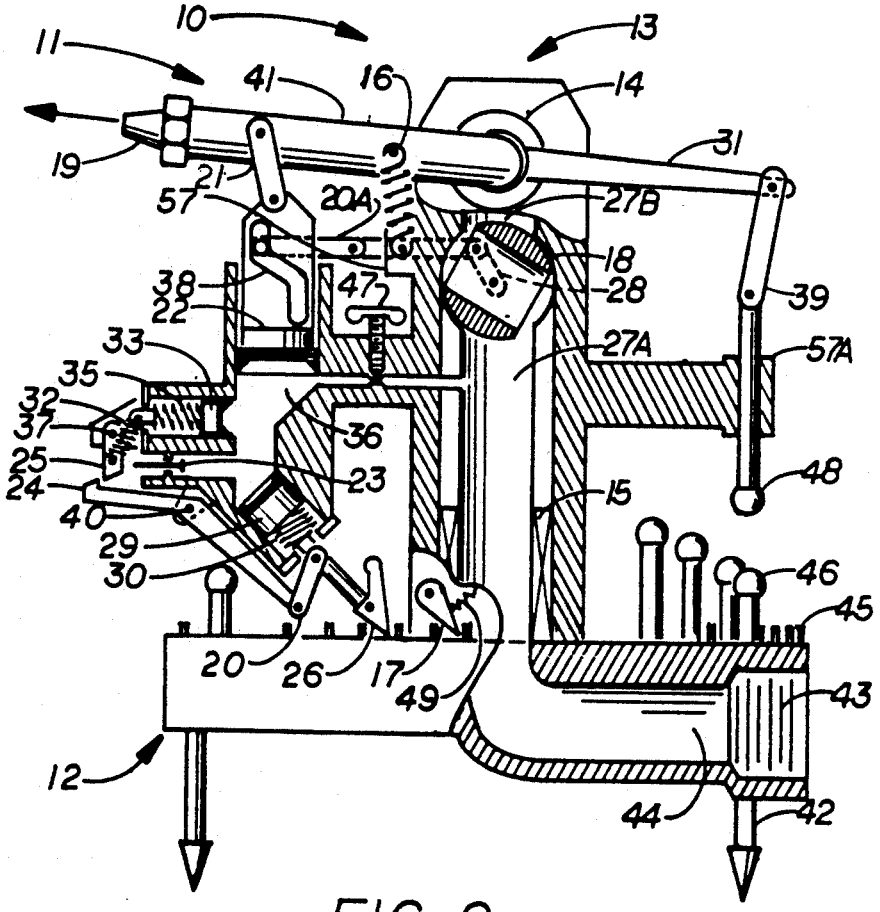
FIG. 2 is a part sectional elevation of a water sprinkler according to the present invention with portions rotated and spaced apart for clarity.

Reference is now made to FIG. 2 which schematically illustrates an embodiment of the present invention generally identified at 10 and operating in accordance with FIG. 1. The embodiment is comprised generally of a nozzle assembly 11 rotatably mounted in a vertical, range, plane upon azimuth rotor assembly 13 which is rotatably mounted in a horizontal azimuth plane upon base assembly 12.

Base assembly 12 is comprised of water connection means 43, water communication means 44, anchors 42, azimuth indexing pins 45 and programmable range stops 46. Said base assembly is typically, though not necessarily molded of plastic with azimuth indexing pins 45 and anchors 42 an integral part of the assembly. However, by definition, said programmable range stops 46 are mounted within holes formed within the base and having adjustable heights relative thereto. It is this variable height relative to the base that forms a mechanical, erasable, programmable, read only memory which is analogous to an "EPROM" within electrical programmable controllers. This user stored site specific data provides range information to the control system which controls the maximum boundary outline of the area to be watered.

Azimuth rotor 13 is rotatably mounted to base 12 on azimuth bearing 15 which is comprised, generally, of two hollow cylindrical members concentrically related and provided with thrust resistant sealing means. These bearings are typical of all known rotary sprinklers and can be constructed of plastic or metal or a combination of both. Water communication means 27 A and B connect index bearing 15 with range bearing 14 for the communication of pressurized water there between. Range bearing 14 is identical to index bearing 15.

Valve 18 is interstitially located between high pressure water communication means 27A and controlled pressure water communication means 27B to control the discharge pressure of nozzle 19 while maintaining high pressure control water to needle valve 47 with its inlet positioned to communicate with high pressure water communication means 27A, and its discharge communicating with hydraulic passage 36. Hydraulic passage 36 thereafter, communicates with range control actuation means 22, cycle reset actuation means 33, and azimuth control actuation means 29, each with their respective return springs 16, 35, and 30. Venting valve 23 is also in communication with hydraulic passage 36. Venting valve 23 is similar to a typical Schrader valve common in tire and inner tube valve stems. This valve is shown without its typical closure spring for clarity. Advantage is taken of the plurality of actuation means to closely sequence operations as will be described later; however, in consideration of the practical need to limit wetted parts, subsequent embodiments illustrate the limiting of the number of actuation means to a single member. Obviously, then, the total number of actuation means is not critical.

Linkage 28 is a lever fixed at one end to valve 18 and rotatably pinned at one end of compressive linkage 20 which is slidably engaged to cam 38. Linkage 20 is rotatably pinned at a central location to linkage 34 also rotatably pinned to to azimuth rotor assembly 13 to form a four bar linkage in order to control the rotational position of linkage 20. Linkage 21 is rotatably pinned to range rotor assembly 11 at its upper end and to range control actuator means 22 at its lower end. Linkage means 31 is fixedly connected to range rotor assembly 11 at its shown left end and rotatably pinned to one end of linkage 39 which is rotatably pinned to the upper end of linkage 48 which slidably engages linkage guide 57A which is aligned to direct linkage 48 to strike range stop 46.

Pawl 17 is rotatably pinned to azimuth rotor assembly 13 and driven by compression spring 49 to rotate clockwise into engagement with azimuth indexing pins 45 in a manner to override said pins as rotor assembly 13 rotates clockwise as viewed from above and to bind on said pins as rotor assembly 13 attempts to rotate counterclockwise. In like manner pawl 26 is rotatably pinned to azimuth control actuator means 29 and driven by compression spring 31 to engage said pins 45 when actuator means 29 extends and override pins 45 when actuator means 29 withdraws. Said elements combine to form a ratcheting mechanism for indexing azimuth.

Linkage 20 is rotatably pinned at its upper end to actuator means 29 and at its lower end to sear 24 in such a manner to cause clockwise rotation of sear around pin 40 as actuator means 29 extends. This brings sear 24 into interference with the path of the linkage lower extreme. It is appreciated that sear 24 must be suitably flexible to override as linkage 25 passes but rigid enough to sustain engagement of hooked end until actuator means 29 withdraws.

Compression spring 32 is rotatably pinned at one end to cycle reset actuator means 33 and at the other to linkage 25 which is rotatably pinned at its upper end to rotor assembly 13. Said linkages and spring comprise an "over center", "snap action" device such that as actuator means 33 extends, the upper extremity of spring 32 passes through the center line projected through spring 32 connection point to linkage 25 and pivot point 37. The lower end of linkage 25 is designed in barb fashion to override sear 24 as linkage 25 rotates counterclockwise and to engage sear 24 as it attempts to rotate clockwise. Linkage 25 thus engages vent valve 23 to open the valve and maintain it open until actuator means 29 withdraws, disengaging sear 24 from linkage 25.

Generally these linkages, pins, pawls, sear and cam elements are typically plastic or metal in construction and designed to suit the application and function.

Range rotor 11 is comprised of range bearing 14, elbow and water straightener 41 and nozzle 19. Range bearing 14 is identical to azimuth rotor bearing 15. Water straightener 41 and nozzle 19 form a power nozzle which issues a smooth stream of water of maximum range, with the most concise impact area.

In FIG. 2 automatic sprinkler apparatus 10 operates in the following manner. Azimuth rotor 13 is rotatably mounted to base 12 on azimuth bearing 15 and indexed in rotation by azimuth control actuator means 29. This actuator means as all other actuator means herein described are represented as piston and cylinder actuators although other compression actuators like the bellows or diaphragm and tension actuators as described in U.S. Pat. No. 2,844,126 are equally applicable and may be substituted. Azimuth control actuator means 29 is in hydraulic communication with range control actuator means 22 and cycle reset actuator means 33 by means of hydraulic passage 36.

High pressure water is allowed to flow from water communication means 27 within rotor assembly 13 to hydraulic passage 36 at an adjustable flow rate through needle valve 47.

As water enters passage 36, its pressure is exerted equally on all three actuator means (29, 33 and 22). Each actuator means has an individual return spring (30, 35 and 16 respectively) each with differing spring preloads and spring rates such that the actuators operate in the following sequence. As water flows into passage 36, actuator 29 begins extending first because its spring is the softest and has the least preload. As actuator means 29 extends, pawl 26 presses against azimuth indexing pin 45 causing azimuth rotor to index clockwise when viewed from above apparatus 10. Pawl 17 rides over its respective pin 45 to prevent counter rotation as described later. As actuator means 29 bottoms out at its full travel, pressure in passage 36 increases until spring 16 and friction of valve and range bearing are overcome by the force of range control actuator means 22. As actuator means 22 extends, valve 18 is opened by the action of linkages 28 and articulated linkage 20A and cam 38 while linkage 21 causes range rotor assembly 11 to rotate about range bearing 14, increasing its superelevation until range stop 46 is struck by linkage 48.

Range stop 46 is adjustable to its lowest setting which allows nozzle assembly 11 to assume its maximum theoretical range angle of 45 degrees superelevation. In actuality, however, a practical range angle extreme of about 38 degrees provides a range immeasurably close to that of 45 degrees while conserving linkage sizing. At this maximum range position, valve 18 is full open and the device is producing the maximum range possible given the site specific water flow and pressure conditions.

Range stops 46 are adjustable to their highest setting which prevents valve 18 from opening. At this position, the device cycles in azimuth without discharging water from nozzle 19. Thereby, sections of area are left completely omitted from watering. These sections may correspond to buildings, pavement or other areas which are desired to receive no water.

At most times, however, range stops 46 are set between their highest and lowest positions to correspond to the exact range desired at each specific azimuth positions. Basically there is a single range stop provided for each respective azimuth increment. (i.e., there are the same number of equally spaced range stops 46 as there are azimuth indexing pins 45). The particular setting of range stop 46 provides the combined valve 18 position and nozzle 19 superelevation to result in the desired range.

When linkage 48 strikes stop 46, actuator means 22 is prevented from extending further. Pressure within passage 36 increases until spring 35 is overcome and reset actuator means 33 extends. Actuator means 33, compression spring 32 and linkage 25 combine to form a "snap action" or "over center" device to open valve 23. As actuator 33 extends, compression spring is further compressed until it passes over pivot point 37 of linkage 25 at which point linkage 25 reverses position engaging sear 24 and opening valve 23. Valve 23 is similar to a standard Schrader valve and is retained open until each piston returns to its initial position, in reversed order, discharging the working volume of water from passage 36. Actuation means 33 is first to return to its initial position followed by 22 and then 29. As pawl 17 engages azimuth indexing pin 45 to prevent counter rotation, actuator means 29 reaches its initial position causing sear linkage 24 to rotate counterclockwise disengaging linkage 25. As linkage 25 rotates clockwise, valve 23 closes building up pressure to repeat the control sequence.

The specific configuration of linkages 31, 18, 28 and 20 plus cam 38 are designed appropriately to control range rate and water discharge rate to produce uniform water coverage. In like manner, advantage is taken of the fact that as the diameter of the actuator means decreases, the area decreases by the square of this decrease and consequently, the speed of actuation of the respective actuation means increases by this squared ratio. Thereby, the diameters of actuation means 29 and 33 are reduced to the minimum required for their respective operations, thus maintaining azimuth indexing at a minimum elapsed time.

Figure 3:
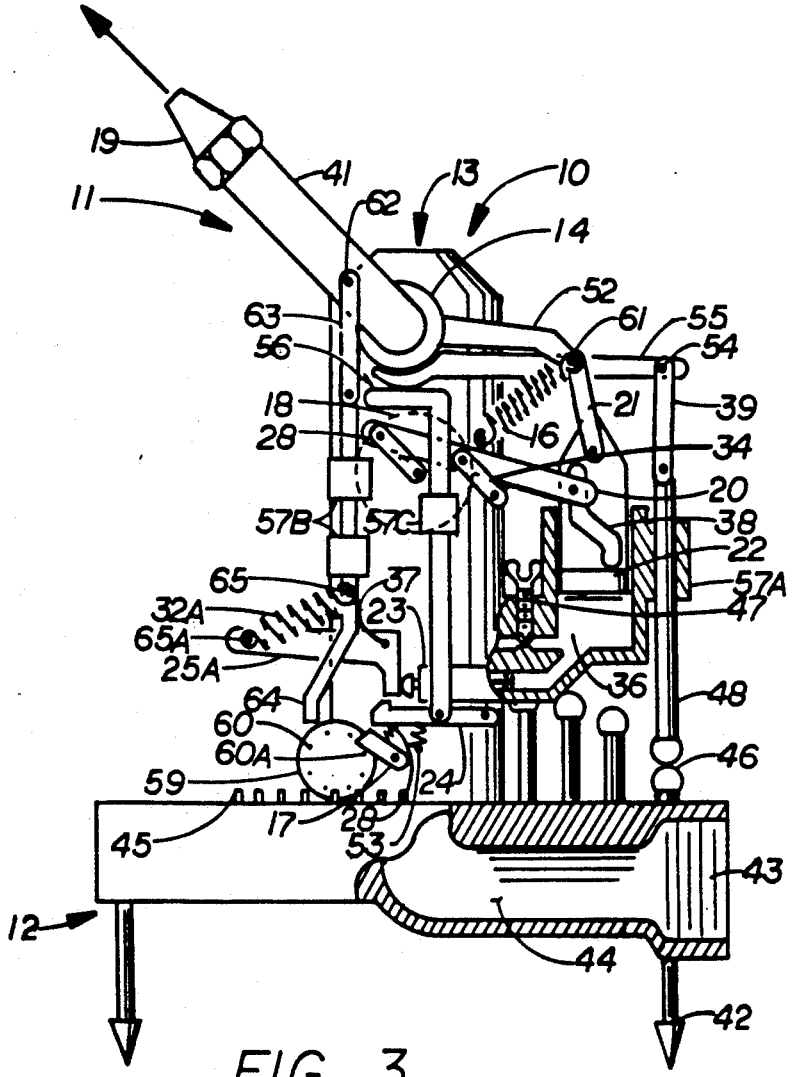
FIG. 3 is a side elevation of an embodiment of the invention with parts broken away.

In FIG. 3 is schematically illustrated an alternate embodiment of robotic sprinkle apparatus 10 which has been modified to use only one actuator means and to accomplish all sequential operations by altered linkages, having the advantage of less wetted parts. Base 12 and range rotor assembly 11 are identical to those illustrated in FIG. 2 with the exception of the location of linkage connection points. Within this embodiment the raised, maximum range, position of range rotor 11 is achieved during the vented condition of water passage 36 and the horizontal position, at the end of the pressurizing cycle of passage 36.

Ratchet wheel 59 has been added to provide compact indexing and to facilitate a later described reversing embodiment of the present invention. Ratchet pins 60 are integrally molded to or attached to wheel 59. The lower end of compression linkage 64 provides the function of azimuth control actuator means and pawl 26. Pawl 17 and spring 49 are modified slightly as are the "over center" device comprising tension spring 32A, linkage 25A and pivot point 37 of linkage 25A on azimuth rotor assembly 13. Linkage 64 is rotatably pinned to linkage 63 which is rotatably pinned to range rotor assembly 11 at pin 62. Thereby the rotation of range rotor assembly 11 provides the motive force for azimuth indexing.

New linkages 52, 55 and 56 are added to release sear 24. Linkage 52 is fixedly connected to range rotor assembly 11 at one end and rotatably pinned at pin 61 to spring 16, linkage 55 and linkage 21. Linkage 55 is rotatably pinned at upper end of linkage 39.

The operation of the embodiment illustrated within FIG. 3 is described within the following sequence. Water enters sprinkler 10 at inlet 43 and is discharged through main nozzle 19 or through control needle valve 47 in identical manner as described for FIG. 2. As water passes through needle valve 42 and enters water passage 36 it operates a single actuation means 22. As actuation means 22 moves upward, cam 38 moves linkage 20 to the right, rotating valve control linkage 28 clockwise, closing the valve (not shown) which is inside rotor assembly 13 in like manner to the description of FIG. 2. Linkage 34 has been provided within this embodiment to create a "four bar linkage" controlling the rotation of linkage 20 as it translates.

As linkage 21 moves upward, with actuation means 22, pin 61 travels upward in an arc around range bearing 14 at the end of linkage 52 rotating range rotor 11 toward horizontal. Linkage 55 rotates counter clockwise while pin 54 and linkage 39 travel upward, and linkage 48 slides within guide 57. In similar manner to the description of FIG. 2, valve 18 position, nozzle 19 direction, and range rate are coordinated to provide uniform radial water distribution.

Counterclockwise rotation of range rotor 11 forces pin 62 and linkages 63 and 64 downward. Linkage 64 lowers without rotation through linkage guides 57. The lower end of linkage 64 strikes pin 60 which rotates ratchet wheel 59 counter clockwise. As pawl 17 under the force of spring 49 overrides and secures another pin 67 on ratchet wheel 59, azimuth rotor 13 advances one azimuth index 107 as described in FIG. 2. As indexing occurs, spring pin 65 at the end of tension spring 66 moves through the center between pin 37 and spring pin 65A which results in rapid counter clockwise rotation of linkage 25 about pin 37. The lower end of linkage 25 engages sear 24 while depressing the stem of valve 23 (valve spring not shown). Spring 53 maintains sear 24 engages with linkage 25 until 63A is released as described later. Since water discharges more rapidly out of valve 23 then it enters through needle valve 47, passage 36 is vented, allowing spring 16 to return all linkage to their original positions.

When linkage 48 strikes range stop 46 pin 54 becomes stationary and the instant center of rotation of linkage 55. This is to say that pin 61 continues to move down while pin 54 is stationary in this manner, the left hand end of linkage 55 forces linkage 56 down, sliding within guide 57C. The bottom end of linkage 56 forces sear 24 down thus disengaging linkage 25 which releases valve 23 to close (valve spring not shown). Thus the cycle starts over.

Since there are portions of lawn and surrounding features which are desired to remain dry, the apparatus is featured with a by pass operating mode for these areas. Within this mode, valve 18 is held tight closed while sear 24 is restrained from contacting linkage 25 thus allowing rapid dithering of linkage 25 sufficient to operate azimuth indexing without opening valve 18. Specifically, range stop 46 is set to its highest position. At this position range rotor is driven to minimum range stop 90 and the action of ratchet wheel 59 indexes azimuth rotor assembly 13 thus driving linkage 48 against stop 46. The curvature of the contact surfaces of linkage 48 and stop 46 are sufficient to ramp 48 up over 46. With range rotor fixed against range stop 90 and consequently pin 61 stationary at its highest position, linkage 55 is forced to rotate ccw about pin 61 causing its left hand end 55A to depress linkage 56 holding seat 24 out of contact with linkage 25.

In this position, linkage 25 rotates into contact with valve 23 discharging water which allows spring 16 to start range rotor rotating clockwise. However with linkage 48 held stationary. linkage 56 is further depressed as pin 61 lowers under the rotation of linkage 52, thus holding sear 24 open. As soon as pin 65 passes above the center line between 65A and 37, linkage 25 snaps out of contact with valve 23 causing apparatus to cycle without the opening of valve 18 because cam 38 is flat in a vertical position which does not start the opening of valve 18. Pressure starts increasing in fluid 36 which rotates range rotor 11 ccw depressing linkage 64 to index ratchet wheel 59 and rotate linkage 25 ccw depressing valve 23. In this manner azimuth is indexed while valve 18 is held closed. As an azimuth position is reached where setting is lower than the by pass position, operation continues in the normal watering mode.

Figure 4:
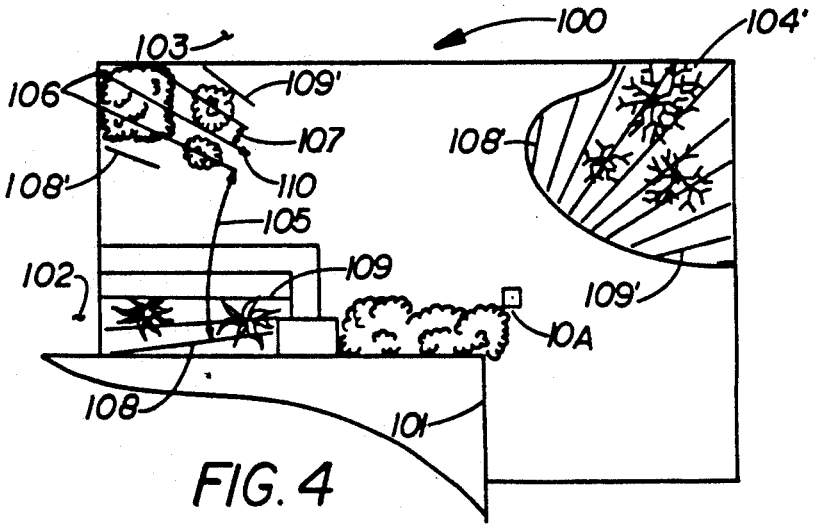
FIG. 4 is a schematic top plan view of an embodiment of the present invention in accordance with the spot watering embodiment and its operative relationship to an irregular area and a building structure.

In FIG. 4 there is schematically illustrated a robotic sprinkler apparatus 10A for watering irregular shaped lawns 100 shown bordered on the sides by residence 101, drive way 102, and street 103, which is similar to FIG. 1 except the embodiment shown at 10A is designed as illustrated later in FIG. 5 for spot watering. Within this embodiment, the structure, actuation and control means coordinate to form a polar coordinate system with the apparatus 10A forming the pole, the nozzle direction defining the azimuthal coordinate 105 and the variable trajectory of the water defining the range coordinate 106 as in FIG. 1. Except, within this embodiment, is included the control means to store minimum range data to enable the coverage of discrete areas which are not in contact with the sprinkler apparatus.

Within the preferred embodiment, uniform water coverage is established by indexing uniformly in azimuth by the angle 107 while range is controlled to define a uniform locus of points which form a radial path of water impact 108. The maximum range of radial path 108 (farthermost extreme of radial path from apparatus 10A) varies as a function of azimuthal orientation and the preset, site specific data stored within the base of apparatus 10A for the respective azimuth direction. Within the embodiment illustrated at 10A is included also the means of limiting the minimum range of 110. The azimuth extremes (108, 109 and 108', 109' likewise are site specific and defined by various control means as will be later shown. In that there is no preset zero azimuth stored within the device, this setting is site specific and to be set by the user or the unit is left to index continuously 360 degrees and repeat.

Figure 5:
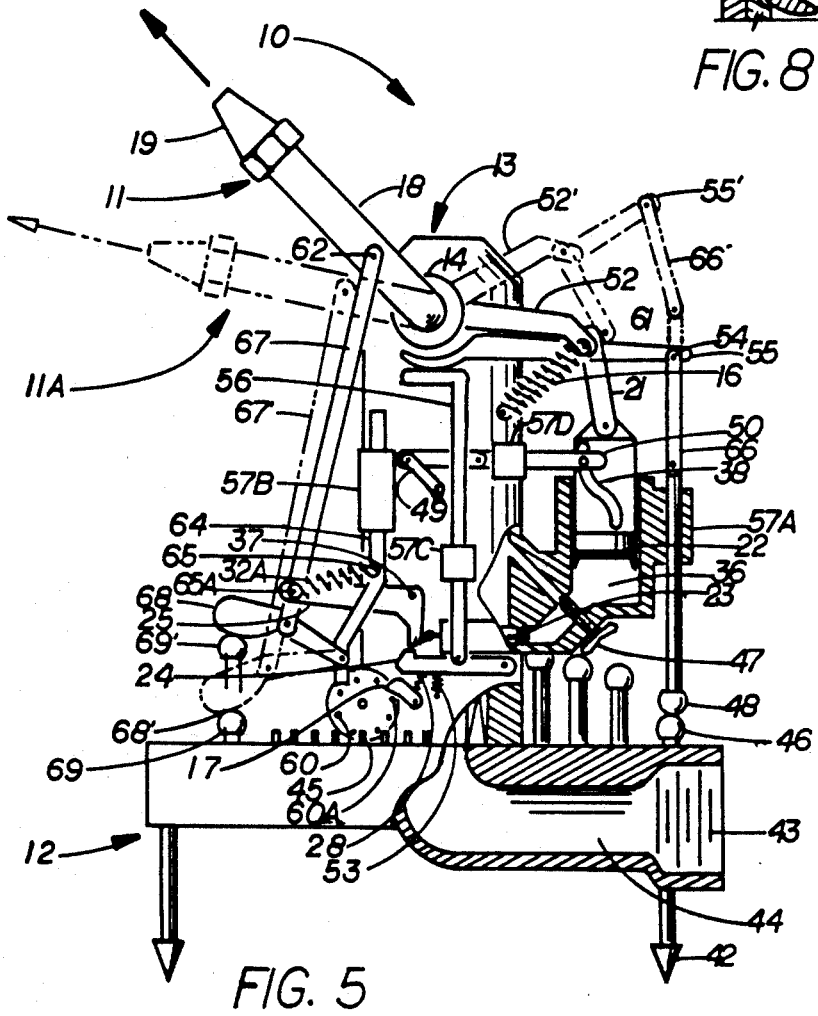
FIG. 5 is a part sectional view of the embodiment of the present invention in accordance with the spot watering embodiment.

In FIG. 5 is schematically illustrated an alternate embodiment at robotic sprinkler apparatus 10A which has been modified for spot watering as was illustrated in FIG. 4. This operation is provided by the addition of an adjustable minimum range stop 69 and linkages 67 and 68 and elimination of linkage 63 to recycle the actuation means at site specific minimum ranges in a similar manner to the maximum range components.

In operation, 10A initiates it's cycle at maximum range with linkage 48 stationarily obstructed by stop 46, forcing sear 24 from engagement with linkage 25, and proceeds toward minimum range in identical fashion to apparatus 10. However, within apparatus 10A, range stop 69 is field adjusted by the user to cause the mechanism to recycle at the desired site specific minimum range instead of zero range as in apparatus 10. As range rotor 11 moves counter clockwise linkage 67 lowers, causes linkage 68 to lower until it contacts stop 69. The left end of linkage 68 is fixedly in contact with stop 69 at 68', and 67 continues downward, moving pin 92 downward with it. Correspondingly pin 91 moves linkage 64 down. As pin 65 on linkage 64 moves down through the center line between pins 37 and 65A, linkage 25 "snaps" ccw opening valve 23 and engages sear 24 while the bottom end of 64 rotates ratchet wheel 59 indexing azimuth incrementally. Valve 23 continues venting control water allowing spring 16 to return device to deenergized condition. The contact of linkage 48 and 46 starts the cycle again as described earlier.

Figure 7A:
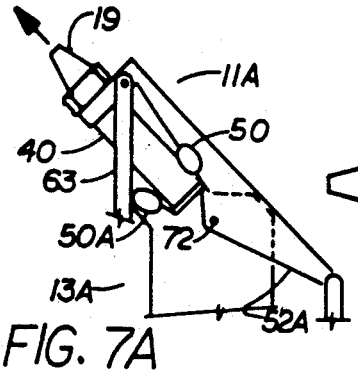
FIG. 7A is a side view detail of an embodiment of the range rotor assembly incorporating a pinch valve into said assembly, showing the apparatus in a maximum range position.
Figure 6:
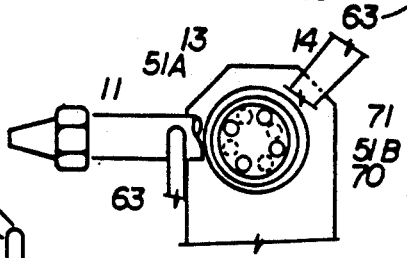
FIG. 6 is a part sectional detail of an embodiment of the range rotor assembly incorporating a slide valve into said assembly.
Figure 7B:
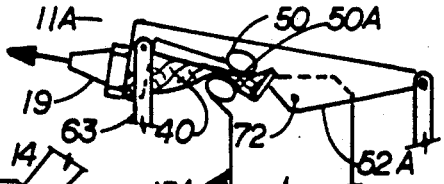
FIG. 7B is a side view detail of an embodiment of the range rotor assembly incorporating a pinch valve into said assembly, showing the apparatus in a minimum range position; and, FIG. 8 is a part sectional detail of the azimuth rotor assembly in accordance with an embodiment of the present invention.

FIG. 6 and FIGS. 7A and 7B illustrate embodiments of the present invention which combine valve 18 and range rotor assembly 11 thus eliminating linkages. FIG. 6 illustrates a slide valve assembly which is not necessarily water tight while the pinch valve of FIG. 7A and 7B is water tight.

In FIG. 6 is illustrated upper portion of azimuth rotor 13 and range rotor assembly 11 modified to incorporate slide valve 71. Slide valve 71 is comprised of orifice plate 51A which is fixedly attached to outer race of range bearing 14 which, in turn, is fixedly secured to azimuth rotor 13, and orifice plate 51B which is fixedly attached to inner race of bearing 14 which is free to rotate with range rotor assembly 11. Orifice plates 51 A and B are comprised of circular disks with orifices 70 radially disposed at equal radii and circumferentially disposed at 90 degree increments. The size of orifices 70 are such that the land between adjacent orifices is larger than the orifice. Thus at minimum range which is illustrated within FIG. 6, the lands of orifice plate 51A are covering the orifices of 51B and conversely 51B covers 51A. As 51B rotates clockwise as range rotor moves to maximum range at 45 Degrees, orifices 70 on both orifice plates 51A and 51B continually move toward alignment which occurs at 45 degrees. Thereby the flow area varies from zero at zero range and maximum at 45 degrees. All other functions of this embodiment are as previously described according to the desired operation.

FIGS. 7A and 7B illustrate a final embodiment combining range rotor assembly 11 and valve 18. FIG. 7A illustrates the assembly at maximum range and full flow and FIG. 7B illustrates the assembly at zero range and zero flow rate. Range rotor assembly 11A is comprised of flexible pressure conduit 40, anvils 50 and 50A, and linkage 52A which cooperate to form a pinch valve. In operation within FIGS. 7A water flows freely within flexible pressure conduit 40 from inlet end attached to azimuth rotor 13A and discharges through nozzle 19 which is connected to the discharge of flexible pressure conduit 40. Within FIG. 7B water flow is illustrated as restricted and ultimately pinched off by the movement of anvil 50 downward and against anvil 50A as linkage rotates counterclockwise about pivot point 72. The pressure exerted by 50 on 50A pinches off the water flow. Again, the other operating parameters are unchanged from previous embodiments.

Figure 8:
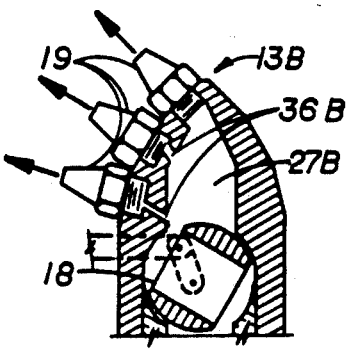

FIG. 8 illustrates an embodiment of the present invention which perhaps sacrifices performance somewhat for the obvious economic advantage of eliminating range rotor assembly 11. Within this embodiment, a plurality of nozzles 19 are fixedly mounted in range angle to azimuth rotor 13B eliminating range rotor assembly 11. Each of the plurality of nozzles 19 are provided with hydraulic passages 36A designed to dissipate water pressure while producing desired turbulence and rotation of water to cooperate with its respective range angle to provide the desired range and water dispersion. To gain the maximum range and accuracy, the top nozzle 19 is superelevated 45 degrees above the horizon and provided full pressure with minimum turbulence. The pattern produced by each nozzle is designed to overlap that of other nozzles to create a continuous pattern which can be progressed uniformly from minimum to maximum range at each specific azimuth angle.

In operation, this device exhibits the same accuracy of control and turn down which is typical of the previous embodiments. The apparatus sits stationary in azimuth while valve 18 operates over its pre-set site specific range until its maximum range is reached. In this case, maximum range is coincident with maximum pressure associated with the maximum open position of valve 18. In this case range operation is accomplished by range actuation means 22, not shown, operating in identical manner to previous embodiments with the exception that there is no range rotor assembly to operate. Azimuth is operated identically to other embodiments, thus providing the typical radial operation of the apparatus which distinguishes it from all other known devices.

This apparatus and control system lends itself equally to above ground or buried, "pop-up" sprinkler systems. Within the latter version, the base is designed to be buried and a typical water actuated piston device is interstitially configured between the base and the azimuth rotor to pop the rotor up when in operation. While this style is not illustrated, a typically conical shape is anticipated with a lid and openings for setting range spaced around the upper rim of the base. A cap ring with inserts to snap into the said openings would prevent plugging of range data settings.

One final embodiment which is incorporated by description but not illustrated is a spring returned version which does not rotate continuously in a single direction; but, is returned by counter-rotating in azimuth to an original position. Within this embodiment, the azimuth rotor is advanced in a fashion identical to the previous descriptions; however, a clock spring connected at one end to the base and to the azimuth rotor at the other, resists the advancement of said rotor. The ratchet wheel 59 prevents counter-rotation. Within this embodiment, however, said ratchet wheel is split into an input ratchet plate and an output ratchet plate connected by a spring loaded clutch plate. This spring loading device is an over-center "snap-action" device which is normally engaged. As the azimuth rotor advances, a lever engages a tripping device mounted upon said base and disengages clutch at a user set location. Rotor rotates back to its initial orientation at which point another preset tripping device engages clutch to secure rotor and start cycle over.

I claim:

1. An automatic, robotic sprinkler for providing a polar coordinate control system for uniformly distributing water over controlled areas of regular or irregular shapes, said sprinkler comprising:

a base adapted for fixedly mounting to the earth comprising a pressurized water connecting and communicating means, a range data storage means for containing adjustable, user programmed, site specific range data for a plurality of positions;

an azimuth rotor assembly comprising, a first water communicating means mounted to and having one degree of rotational freedom relative to said base within a first horizontal azimuth plane, a first actuator means utilizing a small control water side stream of said pressurized water to provide the motive force for driving said azimuth rotor assembly, and a linkage connected to said actuator means and engaging said first azimuth indexing pins;

a range rotor assembly comprising a second water communicating means having a second rotational degree of freedom substantially perpendicular to the plane of said first azimuth plane in a generally vertical plane, and a nozzle means fixedly mounted to said second water communicating means whereby the trajectory of a stream of water can be aimed to strike any range coordinate within the maximum range of the stream's trajectory;

a range coordinated watering rate control means, including fixed mechanical linkages for translating a motive force of a second actuator means to a flow rate control valve and said nozzle means for reducing or increasing water flow rate dependant upon the second rotational degree of freedom of the range rotor assembly;

a maximum range control linkage connected with said watering rate control means and engaging said range data storage means for limiting the maximum angle of the second rotational degree of freedom; and an azimuth cycle reset control means connected to said maximum range control linkage and said watering rate control means to index the azimuth rotor assembly within said first azimuth plane.

2. The automatic robotic sprinkler of claim 1 wherein said cycle reset control means is a vent valve for venting said pressurized water, said pressurized water is communicated to said vent valve through a hydraulic passage, the flow of water in said hydraulic passage is controlled by a second flow rate control valve.

3. The automatic robotic sprinkler of claim 2, wherein said cycle reset control means is connected to a second actuator means.

4. The automatic robotic sprinkler of claim 3, wherein said watering rate control means further includes a third flow rate valve in said range rotor assembly.

* * * * *